US010974375B2

(12) United States Patent
Andrina

(10) Patent No.: US 10,974,375 B2
(45) Date of Patent: Apr. 13, 2021

(54) DEVICE FOR EXTRACTING AND INSERTING BUSHES

(71) Applicant: Giovanni Andrina, Turin (IT)

(72) Inventor: Giovanni Andrina, Turin (IT)

( * ) Notice: Subject to any disclaimer, the term of this patent is extended or adjusted under 35 U.S.C. 154(b) by 274 days.

(21) Appl. No.: 16/339,456

(22) PCT Filed: Sep. 26, 2017

(86) PCT No.: PCT/IT2017/000204
§ 371 (c)(1),
(2) Date: Apr. 4, 2019

(87) PCT Pub. No.: WO2018/066010
PCT Pub. Date: Apr. 12, 2018

(65) Prior Publication Data

US 2020/0039040 A1 Feb. 6, 2020

(30) Foreign Application Priority Data

Oct. 7, 2016 (IT) ..... 102016000101077

(51) Int. Cl.
*B25B 27/06* (2006.01)

(52) U.S. Cl.
CPC ..... *B25B 27/062* (2013.01)

(58) Field of Classification Search
CPC ..... B25B 27/062
See application file for complete search history.

(56) References Cited

U.S. PATENT DOCUMENTS 869,861 A * 10/1907 Alspaugh ..... B25B 27/062 29/265
1,369,172 A * 2/1921 Hall ..... B25B 27/062 29/265
1,369,544 A * 2/1921 Renfro ..... B25B 27/062 29/262
1,465,124 A * 8/1923 Gardner, Jr. ..... B25B 27/062 29/263
1,608,407 A * 11/1926 Macias ..... B25B 27/062 29/263

(Continued)

FOREIGN PATENT DOCUMENTS

DE 202011003962 U1 * 5/2011 ..... B25B 27/023
DE 202011051184 U1 * 11/2011 ..... B25B 27/064

(Continued)

*Primary Examiner* — Jacob J Cigna
(74) *Attorney, Agent, or Firm* — Franco De LiGuori; DP IP Group

(57) ABSTRACT

A device (10) for extracting and inserting bushes (20) is described, comprising a short pipe (11) with two longitudinal slits (16), a tie-rod (12) capable of being inserted in the short pipe (11), a traction bracket (15) capable of being connected to the tie-rod (12) for exert a traction onto the bush (20) to be extracted with two projections (18) capable of being inserted in the slits (16) when the traction bracket (15) is inserted in the short pipe (11), a tie-rod stopping element (24), a short pipe stopping element (25), and bracket stopping elements (26) when inserting the bush (20); such device (10) is used for extracting and for inserting the bush (20) in a seat (35) using a traction device (28) blocked against the short pipe (11) by the tie-rod stopping element (24) connected to the tie-rod (12).

10 Claims, 8 Drawing Sheets

(56) References Cited

U.S. PATENT DOCUMENTS

| | | | | | |
|---|---|---|---|---|---|
| 2,068,021 | A * | 1/1937 | Hamman | B25B 27/062 29/263 |
| 2,234,824 | A * | 3/1941 | Kingston | B25B 27/062 29/263 |
| 2,292,739 | A * | 8/1942 | Bradbury | B25B 27/023 29/265 |
| 3,688,381 | A * | 9/1972 | Shiflet | B23P 19/02 29/263 |
| 4,011,648 | A * | 3/1977 | Martinson | B25B 27/062 29/264 |
| 5,623,761 | A * | 4/1997 | Chiang | B25B 27/062 29/260 |
| 2019/0054603 | A1* | 2/2019 | Liu | B25B 27/062 |
| 2019/0224822 | A1* | 7/2019 | Yang | B25B 27/062 |

FOREIGN PATENT DOCUMENTS

| | | | | |
|---|---|---|---|---|
| GB | 191104601 | A * | 1/1912 | B25B 27/062 |
| JP | 2015134392 | A * | 7/2015 | |

* cited by examiner

DEVICE FOR EXTRACTING AND INSERTING BUSHES

The present invention refers to a device for extracting and inserting bushes, which allows extracting a bush to be replaced from its seat and replacing it afterwards with a new bush using the same device to insert it in the seat.

In particular, the invention refers to a device for extracting and inserting big-sized bushes, such as the bush which is inserted in the seat obtained inside a demolishing hammer to hose the tool, but can be used for replacing other types of bushes, which are inserted inside a seat.

Devices or fixtures are known for extracting bushes from a seat, or for inserting them inside a seat.

These known devices however are not satisfactory and do not allow using the same device both for extracting and for inserting a bush; these devices further require to perform the replacement intervention of the bush in a warehouse, not being portable.

Object of the present invention is solving the above prior art problems, by providing a device for extracting and inserting bushes which allows an easy and quick replacement of a bush on the site where the intervention has to be performed, using a single device.

The above and other objects and advantages of the invention, as will result from the following description, are obtained with a device for extracting and inserting bushes as claimed in claim 1. Preferred embodiments and non-trivial variations of the present invention are the subject matter of the dependent claims.

It is intended that the enclosed claims are an integral part of the present description.

The present invention will be better described by a preferred embodiment thereof, provided as a non-limiting example, with reference to the enclosed drawings, in which.

Figure 8A:
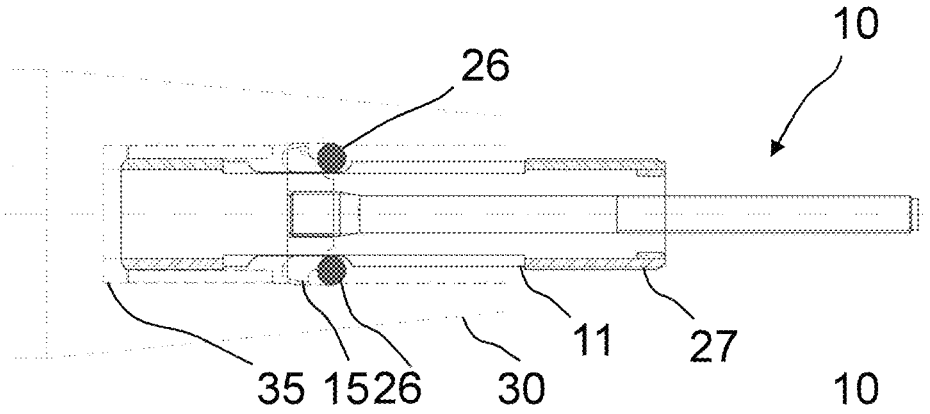
Figure 8B:
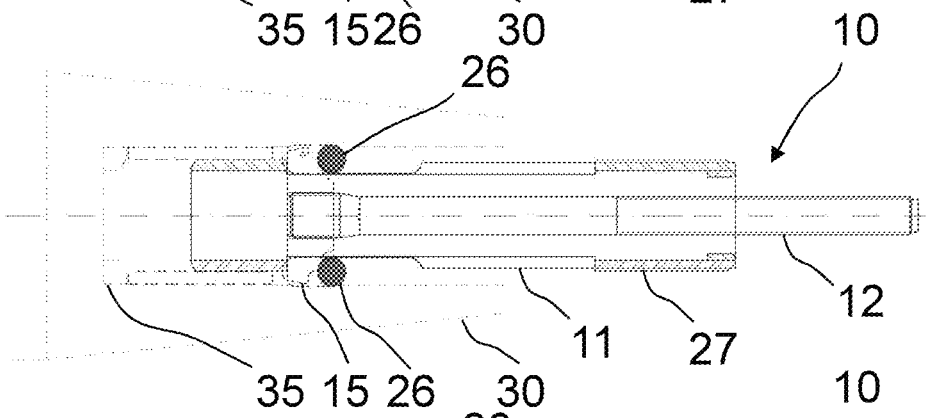
Figure 8C:
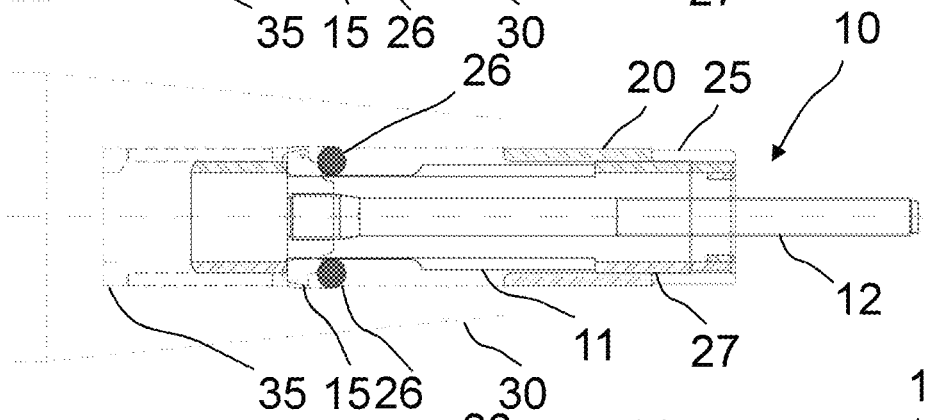
Figure 8D:
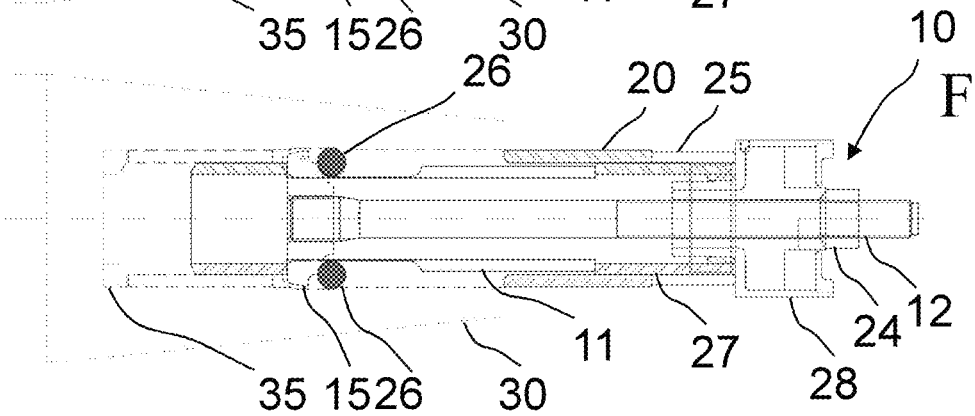
Figure 8E:
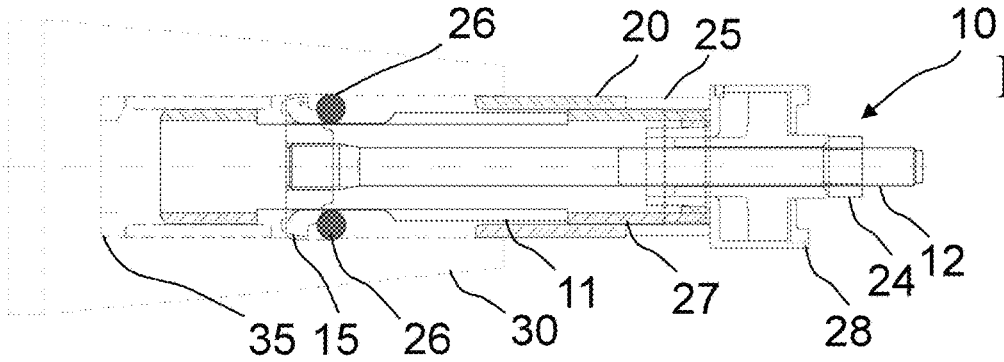
Figure 8F:
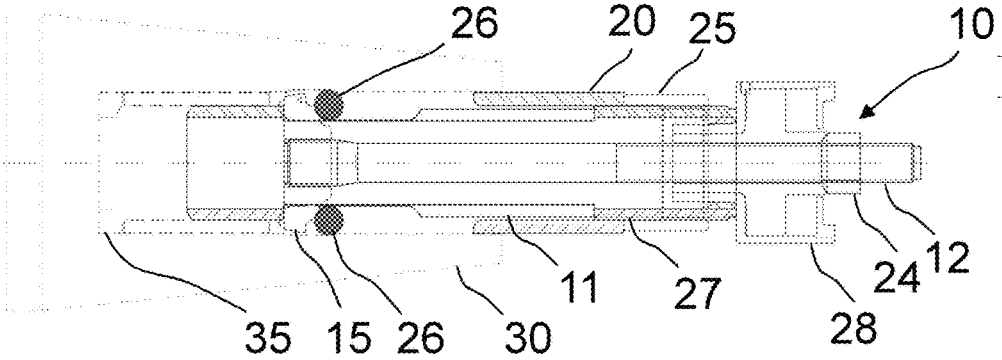
Figure 8G:
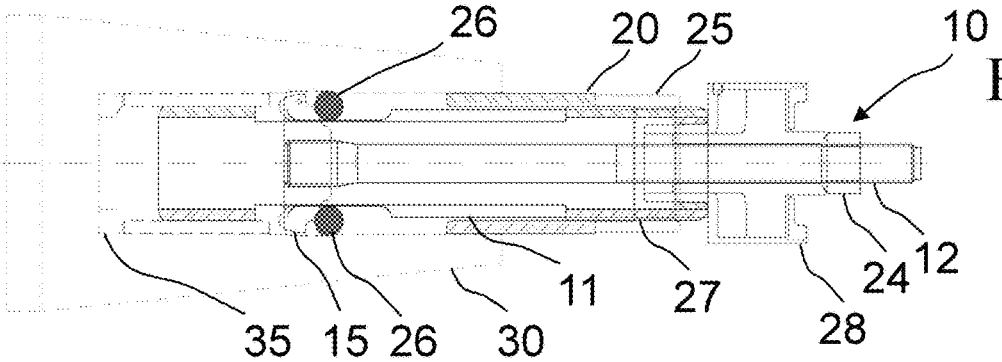
Figure 8H:
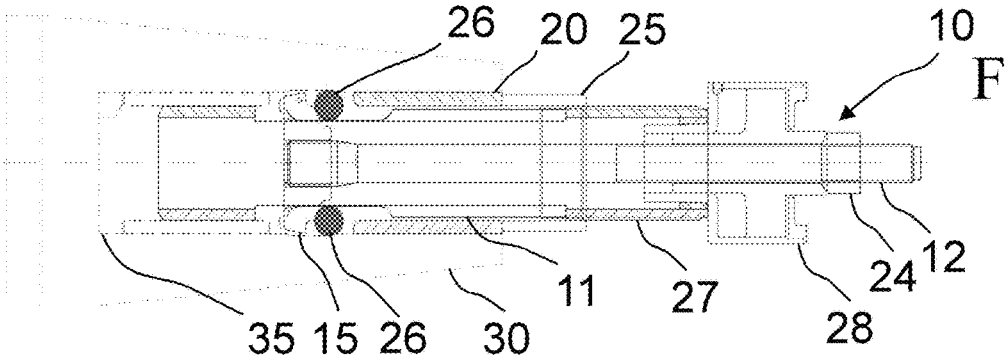
Figure 9:
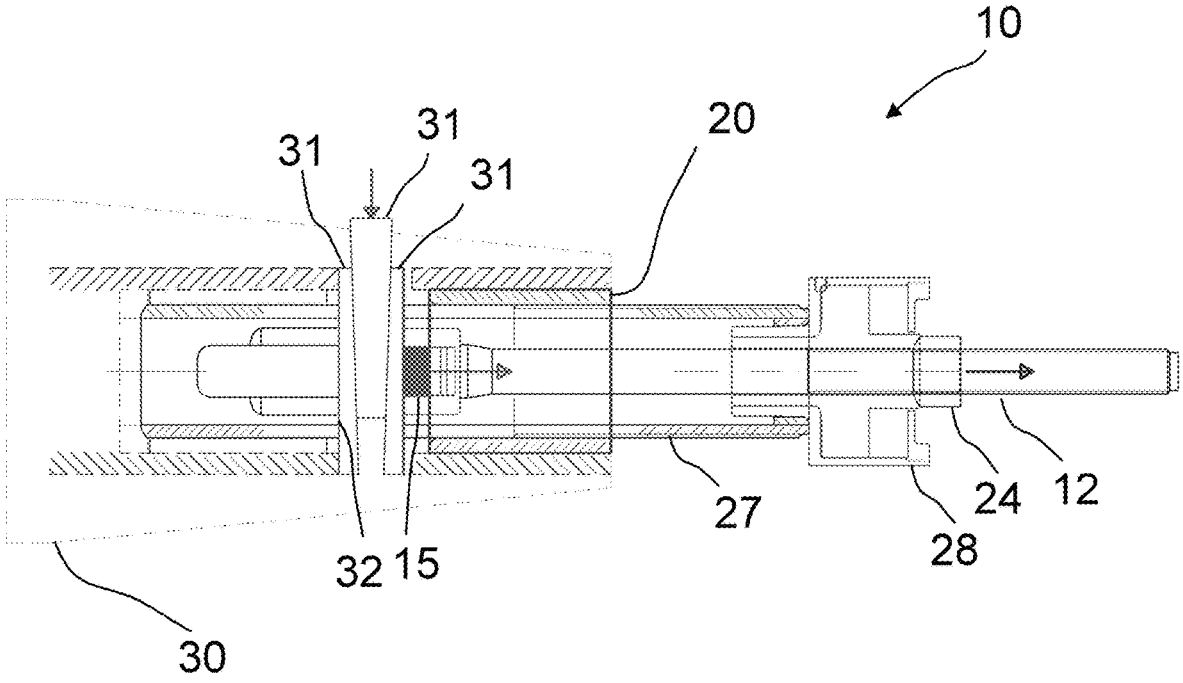

FIGS. 7*a*-7*f* show a device for extracting and inserting bushes according to the present invention during the steps for extracting a bush;

FIGS. 8*a*-8*h* show a device for extracting and inserting bushes according to the present invention during the steps for inserting a bush; and FIG. 9 shows a device for extracting and inserting bushes according to the present invention during an optional step of extracting a bush.

With reference to the Figures, a preferred embodiment of the device 10 for extracting and inserting bushes of the present invention is shown and described. It will be immediately obvious that numerous variations and modifications (for example related to shape, sizes, various colors and parts with equivalent functionality) can be made to what is described, without departing from the scope of the invention as appears from the enclosed claims.

The device 10 for extracting and inserting bushes 20 according to the invention comprises a short pipe 11, a tie-rod 12 capable of being inserted in the short pipe 11, a traction bracket 15 capable of being connected to the tie-rod 12 and adapted to exert a traction on the bush 20 to be extracted.

Preferably, the traction bracket 15 has a threaded hole 21 by means of which it can be connected to the tie-rod 12 by screwing it on a first threading 22 obtained on a first end of the tie-rod 12.

The short pipe 11 has a tubular shape and comprises two longitudinal slits 16 obtained on the short pipe 11, preferably one diametrically opposite to the other.

The short pipe 11 further comprises two longitudinal outlets 19 obtained next to the slits 16; preferably, the outlets 19 have a shorter length with respect to the length of the slits 16.

The traction bracket 15 is capable of being inserted in the short pipe 11 by inclining it, and has two projections 18 which are inserted into the slits 16 when the traction bracket 15 is inserted into the short pipe 11, allowing it to be arranged perpendicular to the longitudinal axis of the short pipe 11.

The device 10 for extracting and inserting bushes comprises a tie-rod stopping element 24 adapted to be connected to a second end of the tie-rod 12, for example composed of a nut 24 capable of being screwed onto a second threading 23 obtained on a second end of the tie-rod 12; the device 10 for extracting and inserting bushes further comprises a short pipe stopping element 25 adapted to be connected to an end of the short pipe 11, for example composed of a ring nut 25 able to be screwed onto a short pipe threading 27 obtained on an end of the short pipe 11, and comprises bracket stopping elements 26, for example composed of stopper plugs 26 able to be inserted inside holes 32 of a tool-holder 30 which contains the bush 20, adapted to keep blocked the traction bracket 15 when inserting the bush 20, as will be explained below in detail.

The device 10 for extracting and inserting bushes of the invention is adapted to be used for extracting and for inserting the bush 20 in a seat using a traction device 28, for example an hydraulic cylinder 28, blocked against the short pipe 11 by the tie-rod stopping element 24 connected to the tie-rod 12.

Preferably, the device 10 for extracting and inserting bushes of the invention further comprises wedges 31 able to be inserted inside the holes 32 of the tool-holder 30 in which the bracket stopping elements 26 are able to be inserted, for unlocking the bush 20 to be extracted when it is necessary to apply an additional force to the one exerted by the traction device 28 to obtain the first detachment of the bush 20, as will be explained herein below in more detail.

The operation of the device 10 for extracting and inserting bushes according to the present invention will now be described, during the extraction of the bush 20 from the seat 35, for example composed of a cylindrical hole 35 obtained in the tool-holder 30, as shown in FIGS. 7*a* to 7*f*.

Figure 1:
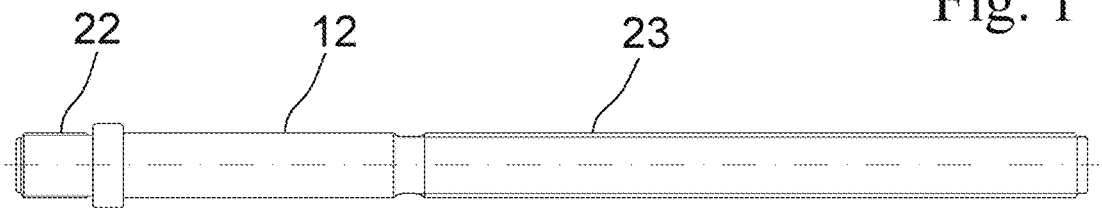
FIG. 1 is a side view of a component of a device for extracting and inserting bushes according to the present invention.
Figure 2:
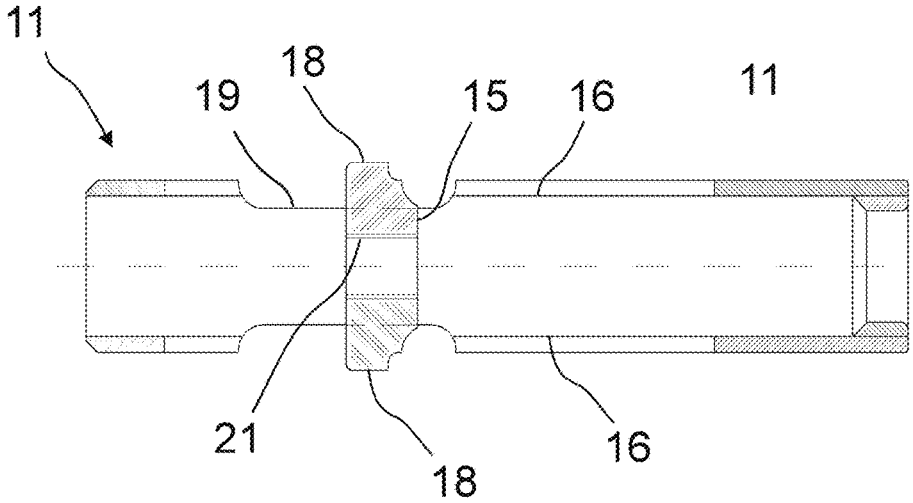
FIG. 2 is a sectional view of two components of a device for extracting and inserting bushes according to the present invention.
Figure 3:
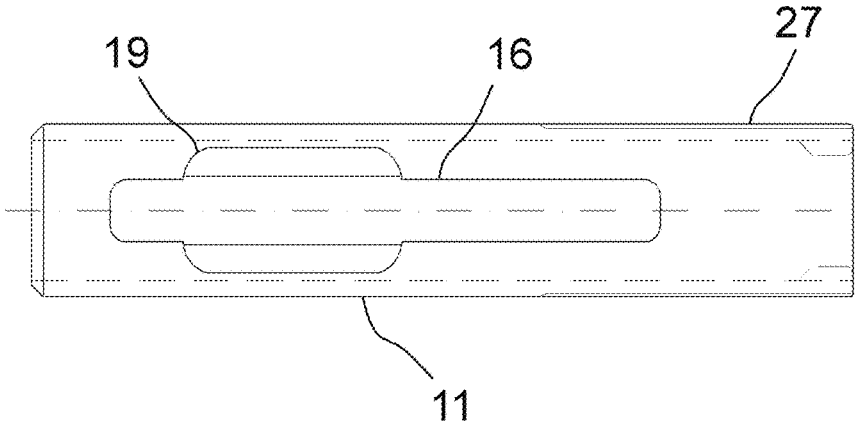
FIG. 3 is a side view of a component of a device for extracting and inserting bushes according to the present invention.
Figure 4:
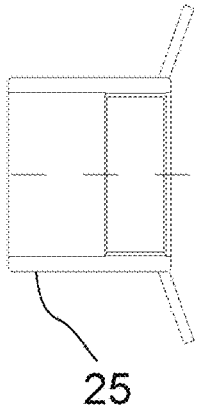
FIG. 4 is a sectional view of a component of a device for extracting and inserting bushes according to the present invention.
Figure 5:
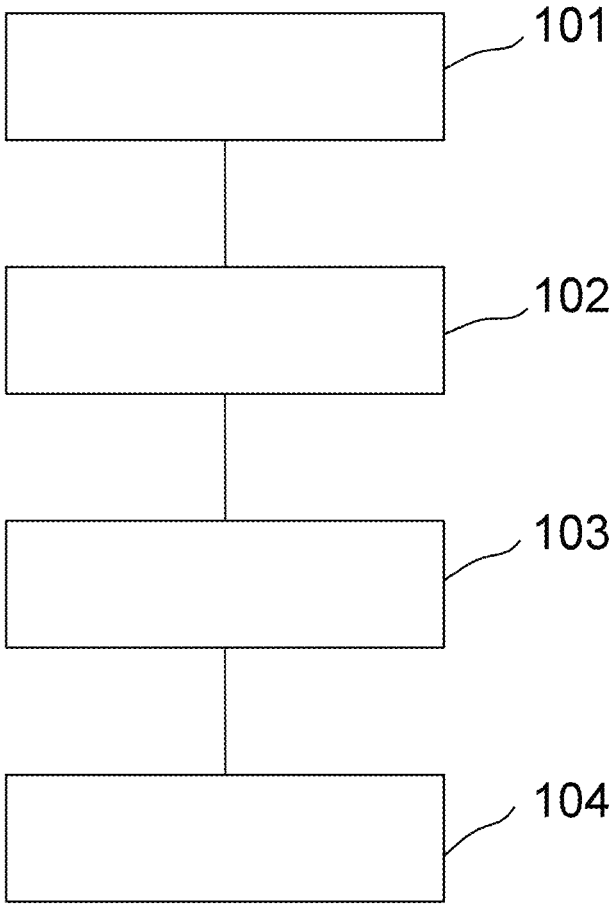
FIG. 5 is a flow diagram of a method for extracting a bush using a device for extracting and inserting bushes according to the present invention.
Figure 6:
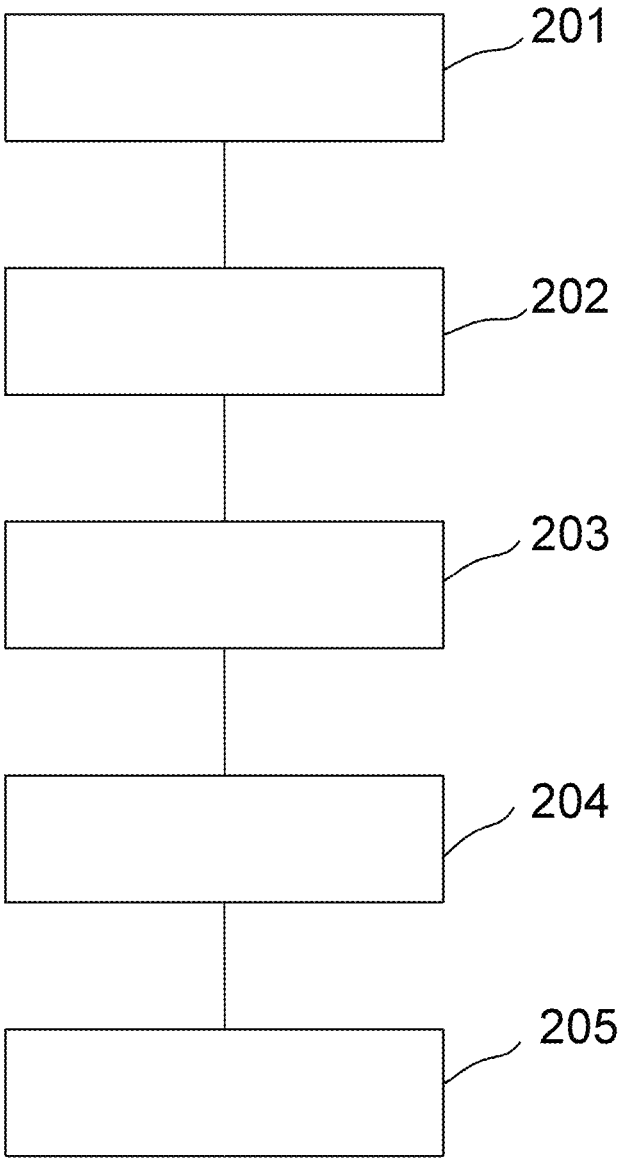
FIG. 6 is a flow diagram of a method for inserting a bush using a device for extracting and inserting bushes according to the present invention.
Figure 7A:
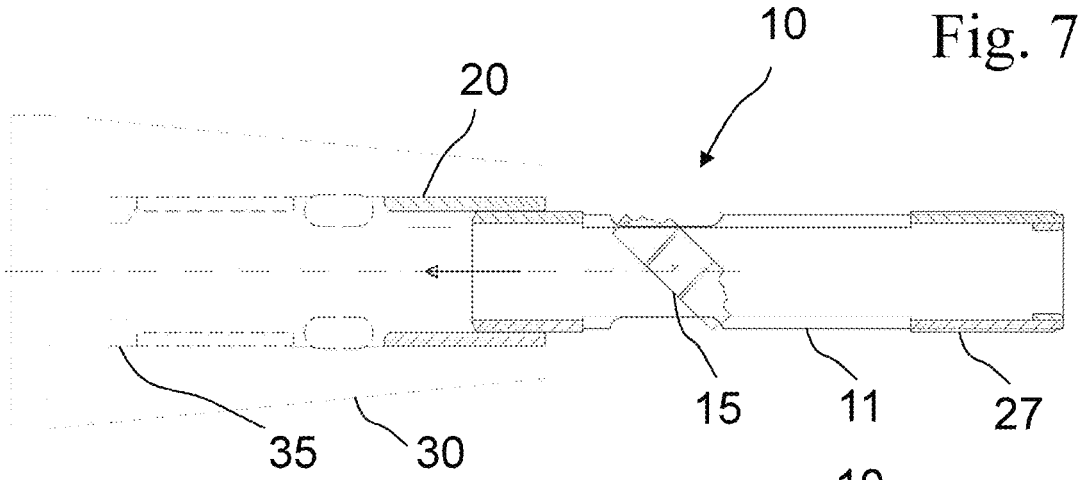

In a first step 101 described in FIG. 7*a*, the short pipe 11 is inserted into the bush 20, in particular the opposite end to the one comprising the short pipe threading 27 is inserted, till the short pipe 11 abuts onto the bottom of the seat 35 in which the bush 20 is assembled; to be able to insert the short pipe 11 into the bush 20, the traction bracket 15 is inclined inside the short pipe 11.

Figure 7B:
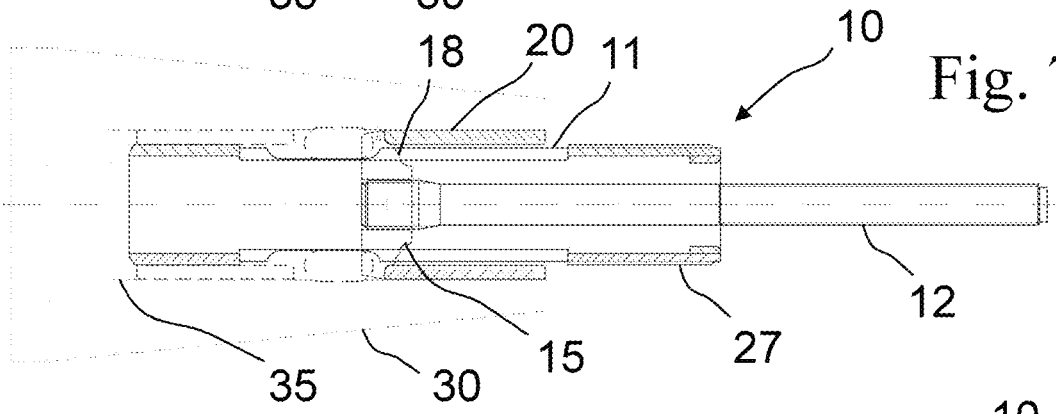

In a second step 102 described in FIG. 7*b*, the traction bracket 15 is placed perpendicular to the axis of the short pipe 11 over the bush 20 to be removed, with the projections 18 in contact with the bush 20, and the tie-rod 12 is connected to the traction bracket 15, in particular is screwed in the threaded hole 21 of the traction bracket 15.

Figure 7C:
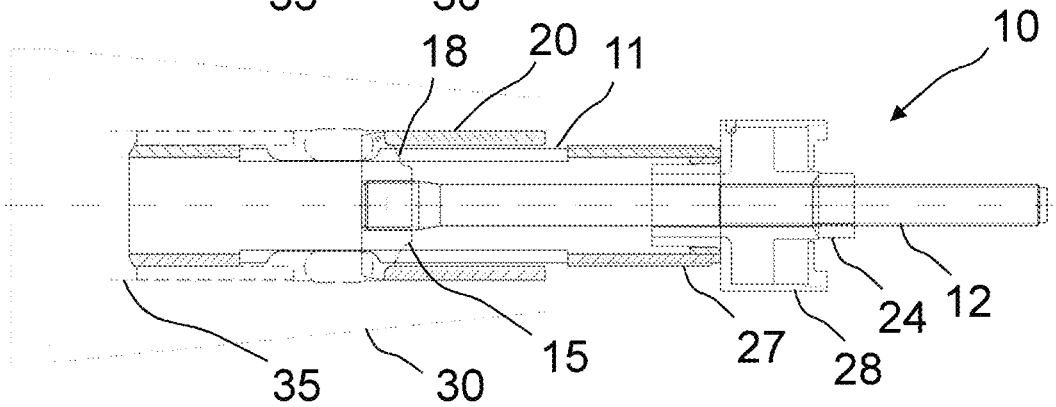

In a third step 103 described in FIG. 7*c*, the traction device 28 is assembled in contact with the end of the short pipe 11 which comprises the short pipe threading 27, and is blocked against the short pipe 11 by the tie-rod stopping element 24 connected to the tie-rod 12, while the traction bracket 15, and in particular the projections 18, is blocked against the bush 20.

Preferably, the traction device 28 is an hydraulic cylinder having a central hole crossed by the tie-rod 12, and the tie-rod stopping element 24 is a nut 24 screwed onto the tie-rod 12 in order to block the hydraulic cylinder 28 against the short pipe 11 and the traction bracket 15, and in particular the projections 18, against the bush 20.

Figure 7D:
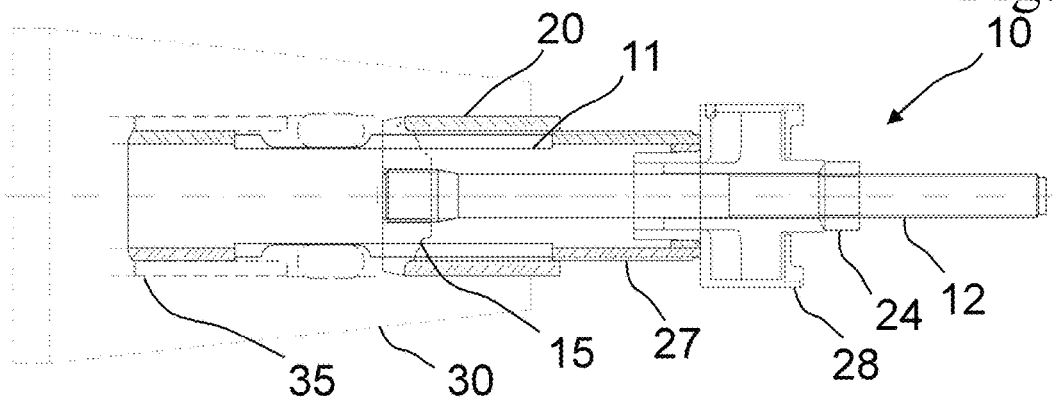
Figure 7E:
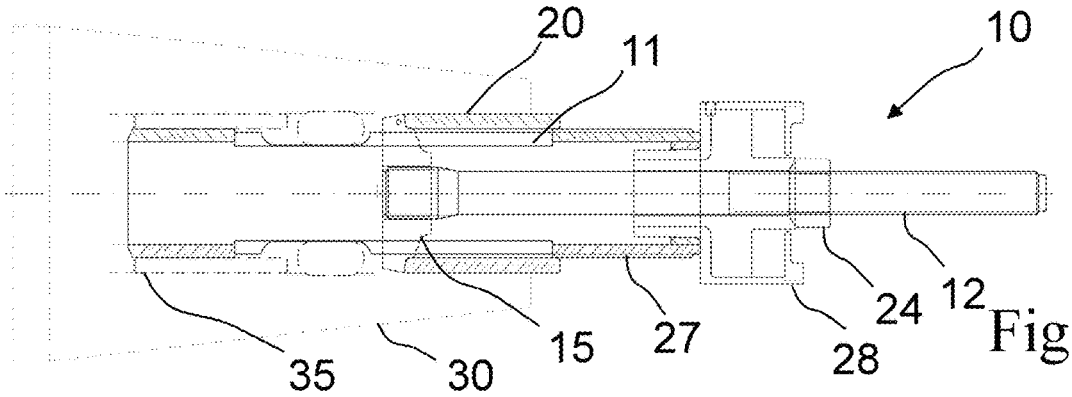

In a fourth step 104 described in FIG. 7*d*, the traction device 28 is actuated, for example the hydraulic cylinder 28, which exerts a force onto the tie-rod 12 and onto the traction bracket 15 connected thereto, and thereby extracts the bush 20 from its seat 35.

Figure 7F:
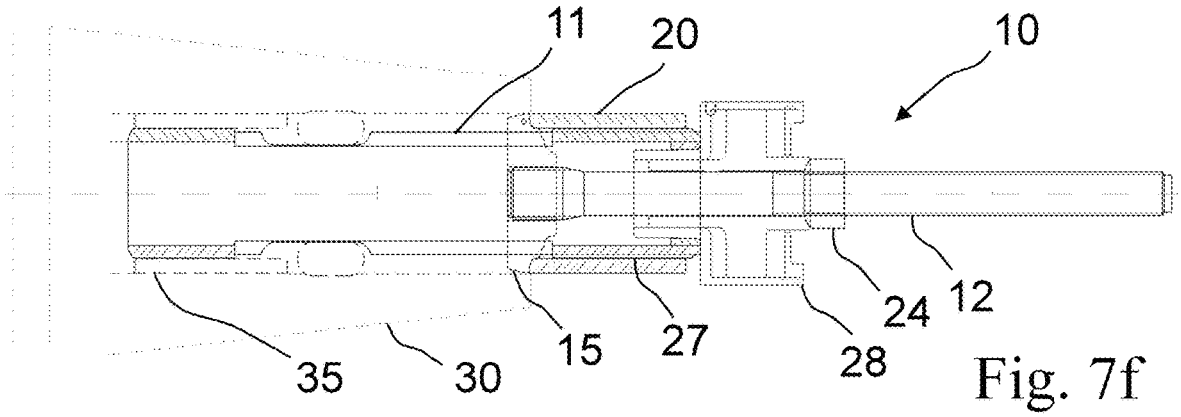

In the embodiment of the device 10 for extracting and inserting bushes of the invention which comprises the hydraulic cylinder 28, if the cylinder arrives at the end of its stroke before the bush 20 is completely extracted, the cylinder is discharged (see FIG. 7*e*), the piston of the cylinder is taken back to its starting position by screwing the nut 24 on the tie-rod 12 and the operation described in the fourth step 104 is repeated till the complete extraction of the bush is obtained, as shown in FIG. 7*f*.

In an optional step of extracting the bush 20 from the seat 35, which is performed before the above described steps if the bush 20, being in its seat for a long time, has developed a gluing by contact, which makes the force exerted by the traction device or hydraulic cylinder 28 not enough to perform the first detachment of the bush 20, the wedges 30 are inserted in the holes 32 and abut onto the traction bracket 15, in particular the projections 18.

Keeping the traction device or hydraulic cylinder 28 under pressure, an additional force is applied, for example by striking with a hammer a central wedge shown in FIG. 9 to perform the first detachment of the bush 20.

Once having performed the detachment of the bush 20, the wedges 31 are removed, in order not to hinder the following operations.

The operation of the device 10 for extracting and inserting bushes according to the present invention when inserting the bush 20 in the seat 35 will now be described, as shown in FIGS. 8*a* to 8*h*.

In a first step 201 described in FIG. 8*a*, the tie-rod 12 is connected, in particular is screwed, to the traction bracket 15 perpendicular to the axis of the short pipe 11, and is pushed together with the traction bracket 15 towards the bottom of the seat 35 in which the bush 20 must be assembled; the bracket stopping elements 26 are assembled blocked in the tool-holder 30, preferably in the longitudinal outlets 19 of the short pipe 11, in order to be between the mouth of the seat 35 and the traction bracket 15, to block the traction bracket 15 preventing it from sliding in the slits 16 towards the mouth of the seat 35; for example, the bracket stopping elements 26 are two stopper plugs 26 inserted inside two holes 32 of the tool-holder 30.

In a second step 202 described in FIG. 8*b*, the short pipe 11 is made slide towards outside the seat 35, till it abuts against the traction bracket 15; the traction bracket 15 therefore is abutting against the edge of the slits 16 on one side and against the bracket stopping elements 26 on the other side, blocked between the short pipe 11 and the bracket stopping elements 26.

In a third step 203 described in FIG. 8*c*, the bush 20 is inserted on the short pipe 11 and the short pipe stopping element 25 is assembled on the short pipe 11 in contact with the bush 20 to push it to the mouth of the seat 35; for example, the short pipe stopping element 25 is a ring nut screwed onto the short pipe threading 27 and is screwed onto the short pipe 11 till it gets in contact with the bush 20 to push it to the mouth of the seat 35.

In a fourth step 204 described in FIG. 8*d*, the traction device 28, for example the hydraulic cylinder, is assembled in contact with the end of the short pipe 11 which comprises the short pipe threading 27, and is blocked against the short pipe 11 by the tie-rod stopping element 24 connected to the tie-rod 12, for example composed of the nut 24 screwed onto the tie-rod 12 in order to block the traction device 28, for example the hydraulic cylinder 28, against the short pipe 11 and block the traction bracket 15, and in particular the projections 18, against the bracket stopping elements 26, for example against the two stopper plugs 26.

In a fifth step 205 described in FIG. 8*e*, the traction device 28, for example the hydraulic cylinder 28, is actuated and exerts a force onto the tie-rod 12 and onto the traction bracket 15 connected thereto; being the traction bracket 15, and consequently the tie-rod 12, blocked by the bracket stopping elements 26, the force of the traction device 28 is applied on the short pipe 11 and on the short pipe stopping element 25, for example the ring nut 25, connected thereto, which is in contact with the bush 20 and pushes it by inserting it into its seat 35.

In the embodiment of the device 10 for extracting and inserting bushes of the invention which comprises the hydraulic cylinder 28, if the cylinder arrives at the end of its stroke before the bush 20 is completely inserted in the seat 35, the cylinder is discharged (see FIG. 8*g*), the piston of the cylinder is taken back to its starting position by screwing the ring nut 25 on the short pipe 11 and the operation described in the fifth step 205 is repeated (FIG. 8*g*) till the bush 20 is completely inserted, as shown in FIG. 8*h*.

The operation ends with the removal of the device 10, which occurs by removing the tie-rod stopping element 24, for example unscrewing the nut 24 of the tie-rod 12, removing the traction device 28 (hydraulic cylinder), the bracket stopping elements 26 (stopper plugs), unscrewing the tie-rod 12 from the traction bracket 15, and extracting the short pipe 11 after having inclined the traction bracket 15 to make it remain inside the short pipe 11.

Advantageously, the device 10 for extracting and inserting bushes of the invention allows an easy and quick replacement of a bush using a single device both for extracting a worn bush and for inserting a new bush.

The invention claimed is:

1. Device (10) for extracting and inserting bushes (20) comprising:

- a short pipe (11) having a tubular shape and comprising two longitudinal slits (16);
- a tie-rod (12) capable of being inserted in the short pipe (11);
- a traction bracket (15) capable of being connected to the tie-rod (12) and adapted to exert a traction on the bush (20) to be extracted with two projections (18) able to be inserted in the slits (16) when the traction bracket (15) is inserted in the short pipe (11);

a tie-rod stopping element (24) adapted to be connected to a second end of the tie-rod (12);

a short pipe stopping element (25) capable of being connected to an end of the short pipe (11) and adapted to exert a thrust on the bush (20) to be inserted;

bracket stopping elements (26) adapted to keep blocked the traction bracket (15) when inserting the bush (20);

said device (10) for extracting and inserting bushes being adapted to be used for extracting and for inserting the bush (20) in a seat (35) using a traction device (28) blocked against the short pipe (11) by the tie-rod stopping element (24) connected to the tie-rod (12).

2. Device (10) for extracting and inserting bushes (20) according to claim 1, characterized in that the short pipe (11) further comprises two longitudinal outlets (19) obtained next to the slits (16) in which the bracket stopping elements (26) are inserted.

3. Device (10) for extracting and inserting bushes (20) according to claim 1, characterized in that the traction bracket (15) has a threaded hole (21) by means of which it is connected to the tie-rod (12) by screwing it on a first threading (22) obtained on a first end of the tie-rod (12).

4. Device (10) for extracting and inserting bushes (20) according to claim 1, characterized in that the tie-rod stopping element (24) is a nut (24) capable of being screwed onto a second threading (23) obtained on a second end of the tie-rod (12).

5. Device (10) for extracting and inserting bushes (20) according to claim 1, characterized in that the short pipe stopping element (25) is a ring nut (25) capable of being screwed onto a short pipe threading (27) obtained on an end of the short pipe (11).

6. Device (10) for extracting and inserting bushes (20) according to claim 1, characterized in that the bracket stopping elements (26) are stopper plugs (26).

7. Device (10) for extracting and inserting bushes (20) according to claim 1, characterized in that it further comprises wedges (31) able to be inserted inside holes (32) of a tool-holder (30) in which bracket stopping elements (26) are inserted, said wedges (31) being adapted to unlock the bush (20) to be extracted when it is necessary to apply an additional force to the force exerted by the traction device (28) to obtain the first detachment of the bush (20).

8. Method for extracting a bush (20) from a seat (35) using a device (10) for extracting and inserting bushes (20), characterized in that it comprises the following steps:

a first step (101) in which a short pipe (11) of the device (10) is inserted in the bush (20) till it abuts onto the bottom of the seat (35) of the bush (20);

a second step (102) in which a traction bracket (15) of the device (10) is placed perpendicular to the axis of the short pipe (11) over the bush (20) to be removed, with projections (18) of the traction bracket (15) in contact with the bush (20), and a tie-rod (12) of the device (10) is connected to the traction bracket (15);

a third step (103) in which a traction device (28) of the device (10) is assembled in contact with the end of the short pipe (11) and is blocked against the short pipe (11) by a tie-rod stopping element (24) of the device (10) connected to the tie-rod (12), while the traction bracket (15) is blocked against the bush (20);

a fourth step (104) in which the traction device (28) is actuated and exerts a force onto the tie-rod (12) and onto the traction bracket (15) connected thereto, and thereby extracts the bush (20) from its seat (35).

9. Method for extracting a bush (20) from a seat (35) using a device (10) for extracting and inserting bushes (20) according to claim 8, characterized in that it comprises the step of inserting wedges (31) inside holes (32) of a tool-holder (30) in which bracket stopping elements (26) of the device (10) are inserted, said wedges being abutted onto the traction bracket (15), and the step of applying a force to at least one of said wedges (31) to perform the detachment of the bush (20).

10. Method for inserting a bush (20) into a seat (35) using a device (10) for extracting and inserting bushes (20), characterized in that it comprises the following steps:

a first step (201) in which a tie-rod (12) of the device (10) is connected to a traction bracket (15) of the device (10) and is pushed together with the traction bracket (15) towards the bottom of the seat (35) in which the bush (20) has to be assembled, and bracket stopping elements (26) of the device (10) are assembled blocked in order to be between the mouth of the seat (35) and the traction bracket (15), to block the traction bracket (15) preventing it from sliding in slits (16) of a short pipe (11) of the device (10) towards the mouth of the seat (35);

a second step (202) in which the short pipe (11) is made to slide towards outside the seat (35) till it abuts against the traction bracket (15), so that the traction bracket (15) abuts against the edge of the slits (16) on one side and against the bracket stopping elements (26) on another side, blocked between the short pipe (11) and the bracket stopping elements (26);

a third step (203) in which the bush (20) is inserted on the short pipe (11) and short pipe stopping element (25) of the device 10 is assembled on the short pipe (11) in contact with the bush (20) to push it towards the mouth of the seat (35);

a fourth step (204) in which a traction device (28) of the device (10) is assembled in contact with the end of the short pipe (11) and is blocked against the short pipe (11) by tie-rod stopping element (24) of the device (10) connected to the tie-rod (12) in order to block the traction device (28) against the short pipe (11) and block the traction bracket (15) against the bracket stopping elements (26);

a fifth step (205) in which the traction device (28) exerts a force on the short pipe (11) and on the short pipe stopping element (25) which is in contact with the bush (20) and pushes it by inserting it in its seat (35).

* * * * *